United States Patent [19]

Tschersich et al.

[11] 4,167,203

[45] Sep. 11, 1979

[54] DEVICE FOR FILLING LIQUIDS INTO BOTTLES AND SIMILAR VESSELS

[75] Inventors: Erwin Tschersich, Bad Kreuznach; Waldemar Mergenthaler, Kalkofen; Ali Pamukcu; Klaus Kaiser, both of Bad Kreuznach, all of Fed. Rep. of Germany

[73] Assignee: Seitz-Werke GmbH, Bad Kreuznach, Fed. Rep. of Germany

[21] Appl. No.: 818,578

[22] Filed: Jul. 25, 1977

[30] Foreign Application Priority Data

Jul. 29, 1976 [DE] Fed. Rep. of Germany ..... 2634021

[51] Int. Cl.[2] ..... B65B 31/00; B67C 3/34

[52] U.S. Cl. ..... 141/59; 141/152; 141/368

[58] Field of Search ..... 141/152, 129–151, 141/153–191, 250–284, 367, 368, 192–198, 392, 37, 39–64, 291–302

[56] References Cited

U.S. PATENT DOCUMENTS 2,989,092 6/1961 Whitecar ..... 141/152

*Primary Examiner*—Houston S. Bell, Jr.

*Attorney, Agent, or Firm*—Becker & Becker, Inc.

[57] ABSTRACT

A device with a plurality of filling elements for filling-in particular still liquids into bottles and similar vessels, in which each of the filling elements respectively comprises an axially displaceable filling pipe and a gas tube with an opening. The filling pipe has on its circumference provided a sealing element for the respective bottle or vessel mouth, which sealing element is axially displaceable thereon by means of a level adjusting device. The adjusting devices for the sealing elements are operable by a mechanism and through the intervention of transmitting members yieldable at least with regard to the axial movement of the filling pipes are drivingly connected to a common drive or are each connected to an individual drive, while in the last mentioned instance the individual devices are controllable by a common control mechanism.

12 Claims, 3 Drawing Figures

DEVICE FOR FILLING LIQUIDS INTO BOTTLES AND SIMILAR VESSELS

The present invention relates to a device with a plurality of filling elements for filling in particular still liquids into bottles or the like containers while the filling elements respectively have an axially displaceable filling pipe and a gas pipe with an opening on the container side, and while the filling pipe on its circumference has a sealing element for the container mouths, the sealing element being axially displaceable by means of a height or level adjusting device.

With filling devices of the just described type, it is known to provide the sealing elements which are respectively associated with the filling elements and which serve for sealing the container mouths during the filling operation, with devices for adjusting the height of the sealing elements in order thereby also to adjust the filling level in the containers German Publication No. 2,331,780. To this end, the height adjusting device respectively provided at the sealing element is designed in the form of a bell receiving the sealing element. The height adjusting device is adjustable as to height and connected to the filling pipe by means of an adjusting thread. In this connection, the sealing element surrounds the circumference of the filling pipe and is longitudinally displaceable thereon. For purposes of adjusting the respective filling heights in the containers, which adjustment is effected by reducing or increasing the distance between the longitudinally displaceable sealing element and the section of the gas pipe on the side of the container, the bell is by means of its thread manually adjusted upwardly or downwardly on the filling pipe. The liquid valve of the filling elements itself is with this heretofore known device formed by a valve body which is stationary and is connected to the gas pipe. The filling pipe is, when pressing the mouth of a container to be filled against the sealing element, displaced relative to the valve body in axial direction counter to the effect of a closing spring, and the liquid valve is opened. In view of the thread connection with the filling pipe, the heretofore known adjusting device is to a major extent not safeguarded against accidental adjustments, and this is the case when the filling machine starts and is about to stop, when being turned-on and turned-off, and also due to accidental actions of the operator, so that undesired filling heights are possible. Furthermore, the respective adjustment of the sealing elements with regard to new filling levels, when changing the containers, especially when filling machines with a plurality of filling elements are concerned, requires a considerable amount of work inasmuch as each element, when the machine is at standstill, has to be adjusted individually and manually as to the same desired filling level. With this manual adjustment, there additionally exists the danger of infection or contamination of the liquid to be filled into the containers.

It is, therefore, an object of the present invention to equip the sealing elements of the device according to the present invention for adjusting the filling level, with a simple, quickly and precisely operable level adjusting device which will permit at the same time an adjustment of all sealing elements while the machine is running and will prevent undesired or accidental adjustments, and which will not affect the axial movability of the filling pipes as it is required for controlling the liquid control valves.

This object and other objects and advantages of the invention will appear more clearly from the following specification in connection with the accompanying drawings, in which.

Figure 1:
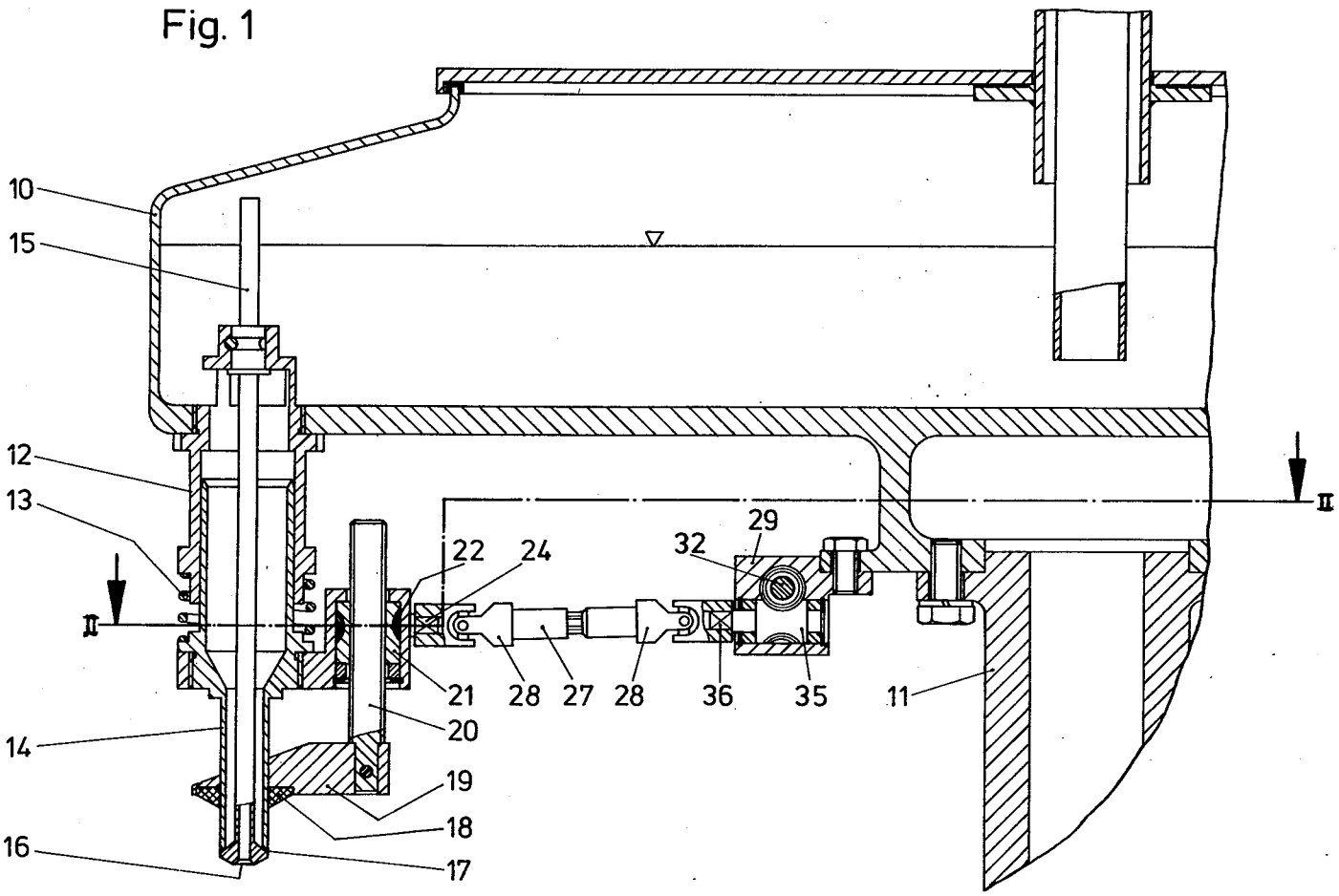
FIG. 1 represents a vertical partial section through a filling device according to the present invention.

The device according to the present invention is characterized primarily in that the adjusting devices for the sealing elements are adapted to be driven and, while employing transmitting means yieldable at least with regard to the axial movement of the filling pipes, are drivingly connected to a common drive or to commonly controllable individual drives.

A device characterized in the above described manner brings about that the sealing element can at any desired distance from the gas pipe opening on the container side be axially adjusted on the filling pipe so that any desired filling level or filling height will easily be adjustable also on such filling elements the filling pipe of which is axially displaceable for purposes of actuating a liquid valve. Above all, the present invention brings about that the adjustment of the sealing elements and thereby of the filling level adjusting device can be effected on a plurality of filling elements which are simultaneously centrally controlled, and can be effected during the operation of the machine as well as with a loaded machine. As a result thereof, the change in the filling level will be uniform on all filling elements. The change in the filling level takes place by means of the device according to the present invention in a minimum of time whereby the output of the filling machine is considerably increased.

According to the present invention, the adjusting devices respectively comprise a self-locking lifting device which carries the sealing element and is connected to the filling pipe, and furthermore comprise a transmission preceding the lifting device and also comprise a connection for the drive transmitting means. According to a preferred embodiment of the present invention, the lifting device in its turn comprises a horizontal arm which carries the sealing element, and includes a spindle fixedly connected to the arm and extending substantially parallel to the filling pipe, and furthermore includes a spindle nut which is located laterally on the filling pipe and is axially stationary but is rotatably mounted. The spindle nut is on the outer circumference designed as a worm wheel and together with an engaging worm, which is provided with the connection for the transmitting means, forms the preceding transmission. This will assure that the sealing element in any position will occupy a safe fit on the filling pipe which is secured against axial displacement. Moreover, it will be assured that the sealing element is always located on the container mouth in a non-jamming and proper position and properly sealed. On the other hand, in view of the spindle and the spindle nut, which is rotatable on the filling pipe itself but is axially stationarily arranged, a precise and safe adjustment of the sealing element in axial direction with regard to the filling pipe will be assured against the axial pressures which are exerted when the container is pressed against the sealing element.

Furthermore, the design of the spindle nut on the outside as worm wheel results in a self-locking arrangement so that a pressure or pull exerted axially upon the spindle cannot cause a turning of the spindle nut and thereby an accidental adjustment of the sealing elements. The transmitting means for the driving connection between the adjusting devices and the respective common drive may, according to the invention, consist of an extensible universal joint shaft, the transmitting means being yieldable relative to the axial movement of the filling pipe. It is also possible to equip the adjusting device with electrical, pneumatic or hydraulic individual drives and correspondingly to employ flexible electric cables or flexible hoses as transmitting means. However, preferably the adjusting device has a connection for the transmitting means which connection is substantially directed transverse to the direction of movement of the filling pipe, and between this connection and the common drive there is inserted a universal joint which is extensible in its longitudinal direction. The universal joint simultaneously prevents the filling pipe from turning about its longitudinal axis. A driving connection which is created in this manner and which is yieldable only in the axial direction of movement of the filling pipe assures that the sealing elements will be uniformly adjusted on all respective filling elements.

This feature can be employed particularly advantageously in connection with filling devices in which the filling elements are coaxially arranged about a supporting frame column. In this connection, preferably the connection for the transmitting means is primarily radially inwardly directed with regard to the column, and the common drive extends annularly around the column.

According to a preferred embodiment of the invention, the common drive is composed of a plurality of connecting elements and one adjusting element while the transmitting elements are connected to the connecting elements, and means are provided on the adjusting element for connection with an adjusting element. The connecting elements may comprise one or more connections for the transmitting elements which connections are directed substantially radially outwardly toward the filling elements or their adjusting elements. By respectively providing a plurality of connections for the connecting elements, the number of the connecting elements required for the filling elements can be considerably reduced. Moreover, the connecting elements may be combined with the adjusting elements to form a unit therewith. According to the present invention, the connecting elements respectively comprise horizontally extending worms which are in mesh with worm wheels arranged on the connections for the transmitting means. Each worm has both ends provided with a connection which projects from the housing of the elements. The connecting elements are by means of universal joint shafts or couplings arranged on the worm connections connected to each other for the common drive. The adjusting element comprises a worm provided with means for connection with the adjusting device and also comprises a worm wheel meshing with the last mentioned worm. The worm wheel is connected to the worm of the adjacent connecting element.

Figure 2:
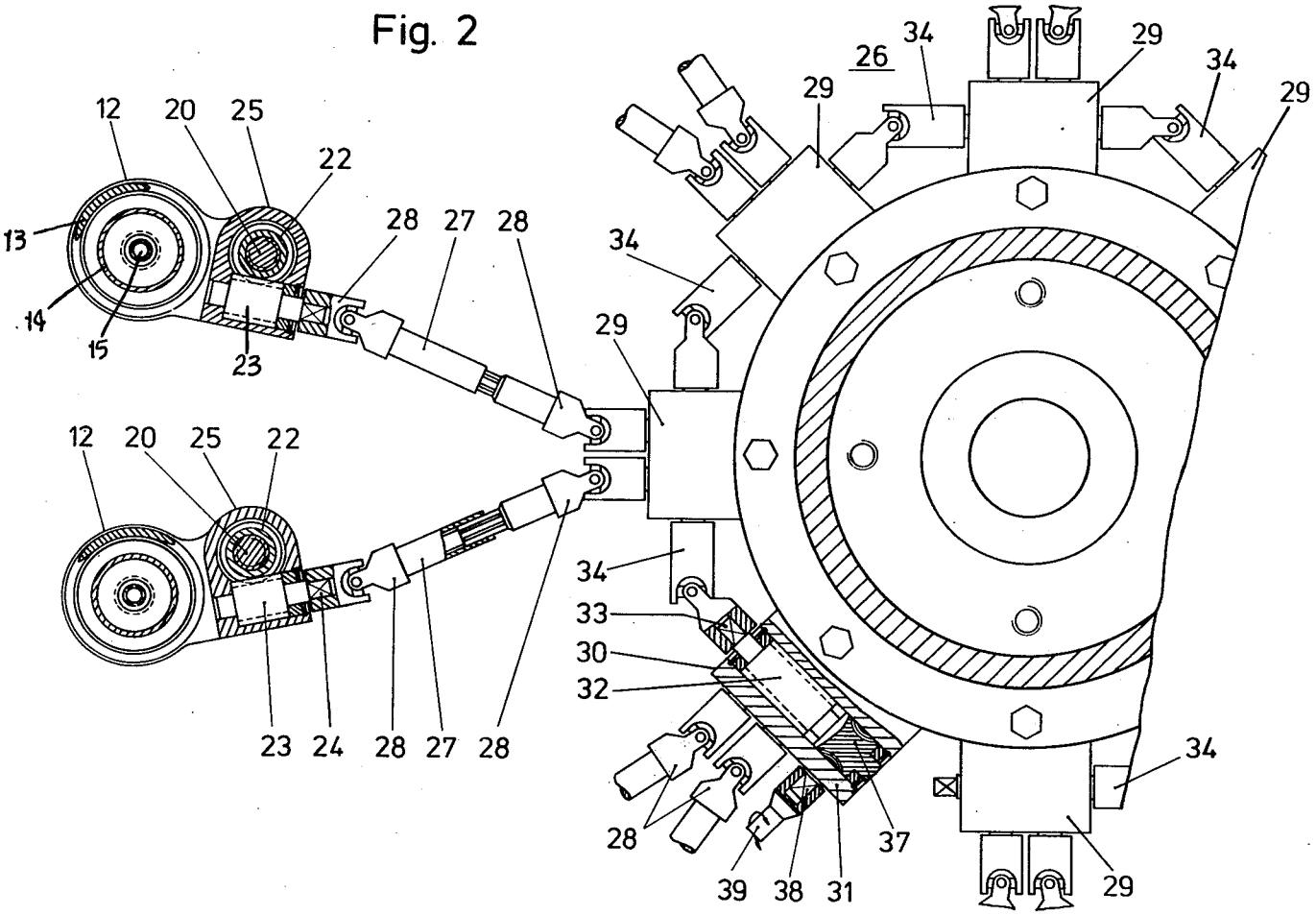
FIG. 2 is a section taken along the line II—II of FIG. 1 and showing a section through the central frame column of the filling device with annularly arranged driving device thereon and with two connected adjusting devices for the filling elements respectively.
Figure 3:
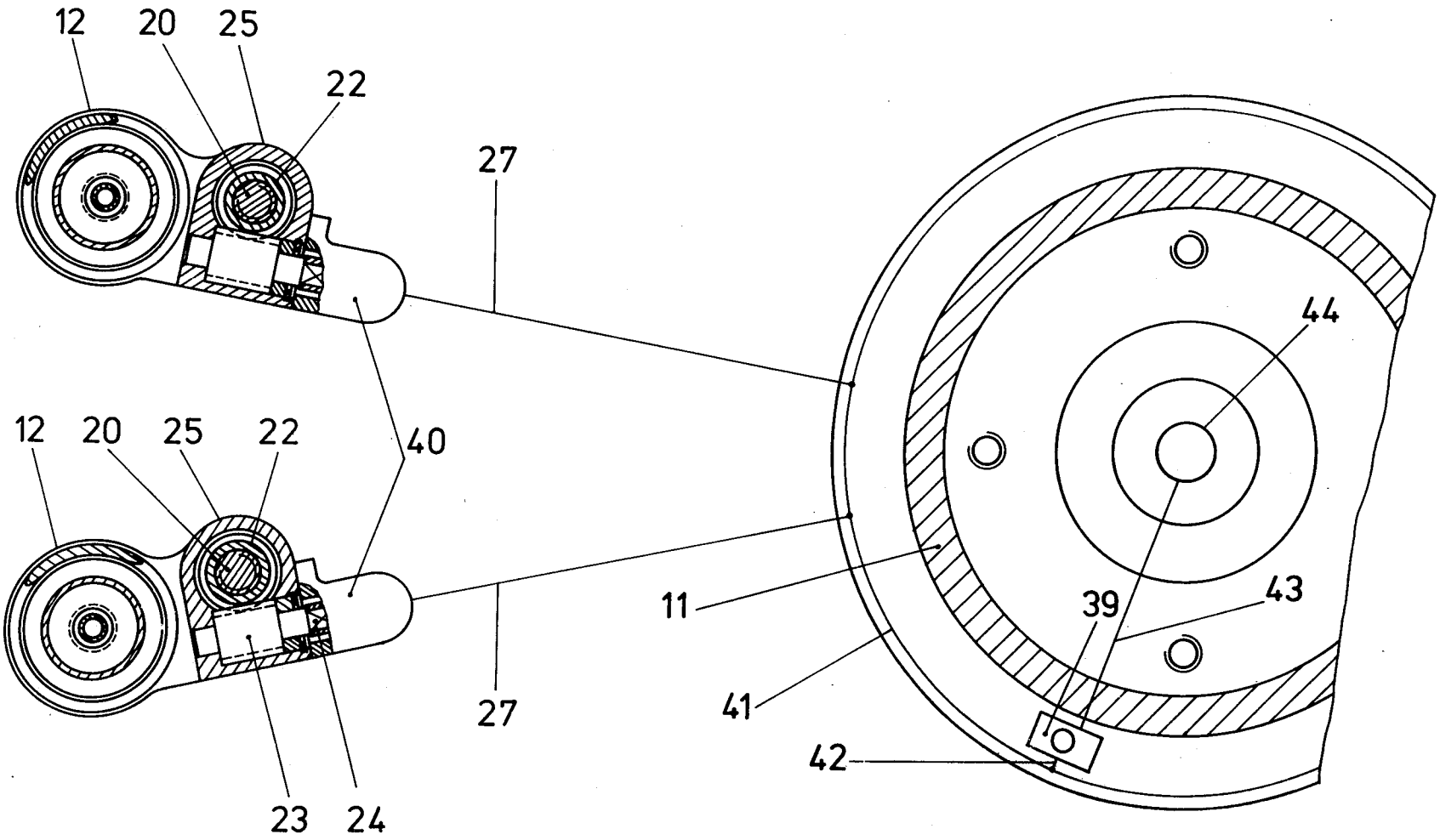
FIG. 3 illustrates a further embodiment of the device of the invention according to which the adjusting devices for the sealing elements are respectively drivingly connected to individual drives having a common motor.

Referring now to the drawings in detail, the embodiment shown therein comprises a vacuum filling device for liquids, for instance beverages. The device includes a liquid receiving container 10 located on a central supporting frame column 11. A plurality, for instance sixteen, filling elements 12 are inserted in the bottom of the container 10 while being arranged about the frame column 11. The filling elements 12 are of customary construction and at their lower ends comprise a filling pipe 14 which is displaceable in upward direction against the thrust of a spring 13 while a stationary gas pipe 15 extends substantially in axial direction of and through the filling pipe 14. The gas pipe 15 which has its upper opening extending into the vacuum region of the container 10 has its lower end provided with a valve body which is provided with a gas pipe opening 16. The opening 16 together with the exit of the filling pipe 14 which is designed as a valve seat forms the liquid valve 17 which by axially displacing the filling pipe 14 assumes its opening position. Mounted on the circumference of the filling pipe 14 is a sealing element 18 having the shape of a sealing cone which is axially displaceable. The sealing element 18 is connected on a laterally extending supporting member 19 in the form of a horizontal arm. By means of the supporting member 19, the sealing element 18 is held on a spindle 20 which extends substantially parallel to the filling pipe 14 and is secured against turning. Arranged on the spindle 20 is a spindle nut 21 which on the outside is designed as a worm wheel 22. The worm wheel 22 is engaged by a worm 23 (FIG. 2) which ends in a connecting end 24 for a drive, the connecting end 24 extending substantially radially in the direction toward the column 11. Such an adjusting device, generally designated 25, for the sealing cone 18 is, as will be seen from FIG. 2, provided for each filling element 12 of the machine.

According to the embodiment of the invention shown in the drawings, a common drive 26 serves for actuating the adjusting devices 25. Connected to the drive 26 are the adjusting devices 25 with universal joint shafts 27 respectively connected to the connecting ends 12. The universal joint shafts 27 are at each end provided with a joint 28 each and are extensible in longitudinal direction. The drive 26 itself comprises seven simple connecting elements 29 and also comprises a connecting element 30 as well as an adjusting element 31. The elements 29, 30 and 31 are annularly arranged about the central column 11. The elements 30 and 31 expediently form a building unit. Each element 29 and 30 comprises a horizontally arranged worm 32 which with the elements 29 at both ends and with the element 30 on one end carries a connection 33 in the form of a square head. The connection 33 laterally projects from the respective element housing. The connections 33 are provided with joints 34 which interconnect the elements 29, 30 to form an annular driving chain. As will be seen from FIG. 1, each element 29 additionally comprises two worm wheels 35 which mesh with the worm 32 and which at one end carry a connection 36 designed as square head. The connection 36 is substantially radially outwardly directed toward the respective filling element 12 or its adjusting device 25. Connected to the connection 36 is the second joint 28 of the respective shaft 27. It is not under all circumstances necessary to provide a precise radial alignment of the connections 24 and 36 because the joints 28 are adapted to compensate for considerable angular deviations.

The adjusting element 31 which is combined with the connecting element 30 is in the illustrated embodiment of the invention provided with a worm wheel 37 which is coaxially connected to the worm 32 of the element 30. The worm wheel 37 is adapted to mesh with a worm (not illustrated) which outside the unit 30, 31 supports a device, for instance a square head 38, for connection with an adjusting device 39. The adjusting device 39 may, for instance, be presented by a manual crank or similar device, an electric motor to be plugged-in or a fixedly installed electromotor adapted to be actuated by actuation of a pushbutton on a non-illustrated stationary switchboard of the filling machine.

The operation of the device is as follows: The container to be filled, for instance a bottle, is from below moved onto the filling element 12 and is lifted so that the filling pipe 15 extends into the interior of the container 10 while the mouth of the container abuts the sealing cone 18. In this connection, the container, through the intervention of the sealing cone 18, lifts the carrier element 19 therefor, the spindle 20 and also the rotatable spindle nut 21 which is held axially stationary with regard to the filling element 12 and thus the adjusting device 25 and also lifts that end of the universal joint shaft 27 which is connected to the adjusting device 25. As a result thereof, the liquid valve 17 is opened and the filling operation can proceed in customary manner. The filling level is in customary manner determined by the distance between the sealing cone 18 and the return gas opening 16. For purposes of adjusting the filling level, the adjusting element 31 is actuated, and the adjusting element 39 is turned in one or the other direction as indicated by the double arrow in FIG. 2. This turning movement is through the worm wheel 37 transmitted to the worm 32 of the element 30 and onto the worms 32 of the remaining elements 29 and is conveyed from the worm wheel 35 of the elements 29 and 30 through the intervention of their universal joint shaft 27 to all adjusting devices. As a result thereof, on all filling elements 12 the sealing cone 18 is adjusted axially with regard to the return gas opening 16 in the same direction and to the same extent. In view of the selected transmission design in the form of a threaded spindle and threaded nut and in view of the worm and worm wheel, the adjusting devices and the common drive connection are self-locking and secured against accidental adjustment.

For actuating the adjusting devices 25 by means of individual drives having a common motor for each of the adjusting devices 25, there is provided an electrical individual drive in the form of a direct current motor 40. In this instance each motor 40 is through a yieldable transmitting element 27 in the form of a flexible electric cable connected to an annular line 41. This line is through a cable 42 electrically connected to a mutator 39 which serves at the same time as adjusting device and is connected to the column 11. The device 39 in its turn is by means of an electric conductor 43 and through a sliding contact 41 connected to the non-illustrated current supply in the stationary control panel of the filling machine.

The common adjustment of the filling level for all filling elements by adjusting the height of the respective sealing cone 18 is effected by means of the mutator 39 which serves as adjusting device and which brings about that the direct current motors 40 will receive voltage and will be driven. Due to their rotary movement, the adjusting devices 25 are adjusted in one or the other direction so that the respective sealing cone 18 is displaced upwardly or downwardly.

It is, of course, to be understood that the present invention is by no means limited to the specific showing in the drawings but also encompasses any modifications within the scope of the appended claims.

What we claim is:

1. A device for filling liquids into vessels, especially bottles, which includes: a container adapted to receive the liquid to be filled into vessels, a plurality of filling elements connected to said container, a plurality of filling pipes respectively axially shiftable and displaceably arranged in said filling elements, a plurality of stationary gas tubes arranged in said filling pipes and extending into said container and having a first opening at that end which extends into said container and also having a second opening at the other end thereof, that gas tube end which contains said second opening forming a valve with the respective adjacent end of the pertaining filling pipe, sealing means respectively axially shiftable and displaceable in common with said filling pipes for engagement with the mouth of the vessels to be filled with liquid for assured opening of liquid discharge, individual adjusting means operatively connected to each said sealing means for both upwardly and downwardly adjusting the latter as to height, and common actuating means operatively connected to said individual adjusting means for actuating the latter to assure that both from a central location said sealing means are adjustable upwardly and downwardly for setting of filling level and also liquid discharge of each filling element can be opened and closed with certainty by way of a particular bottle to be filled.

2. A device according to claim 1, in which said actuating means include transmitting means yieldable at least with regard to the axial movement of said filling pipes, and a drive common to and operatively connected with said adjusting means.

3. A device according to claim 1, in which said actuating means include transmitting means yieldable at least with regard to the axial movement of said filling pipes, individual drives respectively drivingly connected to said adjusting means, and control means common to and drivingly connected to said individual drives.

4. A device according to claim 1, in which each of said adjusting means includes: self-locking lifting means connected to the pertaining filling pipe and supporting said sealing means, transmission means preceding said lifting means and operatively connected thereto, and connecting means operatively connected to said transmission means for connection with a drive.

5. A device according to claim 4, in which said lifting means includes: a substantially horizontal arm supporting said sealing means, spindle means fixedly connected to said arm and extending substantially parallel to the respective adjacent filling pipe, rotatable spindle nut means in mesh with said spindle means and laterally mounted on the respective adjacent filling pipe, said nut means being axially non-displaceably arranged, said spindle nut means having its outer circumference designed as worm wheel, and a worm forming part of said transmission means and meshing with said worm wheel.

6. A device according to claim 2, which includes an extensible universal joint interconnecting said adjusting means and said common drive.

7. A device according to claim 4, which includes a substantially central frame column, and in which said connecting means for said actuating means are directed substantially radially inwardly toward said frame column, and a drive common to and operatively connected with said adjusting means and annularly surrounding said frame column.

8. A device according to claim 7, in which said common drive includes a plurality of connecting elements and an adjusting element, and in which said actuating means are connected to said connecting elements, and means associated with said adjusting element for connection to a setting device.

9. A device according to claim 8, in which said connecting elements comprise connecting means for connection with said actuating means, said connecting means extending substantially radially outwardly with regard to said filling elements.

10. A device according to claim 8, in which said connecting elements are respectively combined with said adjusting elements to form a structural unit therewith.

11. A device according to claim 9, in which said connecting means include worm wheel means, and in which each of said connecting elements respectively comprises a substantially horizontally extending worm meshing with said worm wheel means, and universal joint means, said connecting elements being drivingly interconnected and being connected to said common drive by means of said universal joint means.

12. A device according to claim 8, in which each of said adjusting elements comprises a worm provided with means for connection with an adjusting device and also comprises a worm meshing with the respective pertaining worm wheel which latter is connected to the worm of the respective connecting element.

* * * * *